US007231782B2

(12) United States Patent
Jung

(10) Patent No.: US 7,231,782 B2
(45) Date of Patent: Jun. 19, 2007

(54) REFRIGERATOR

(75) Inventor: Sang Gyu Jung, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 613 days.

(21) Appl. No.: 10/756,385

(22) Filed: Jan. 14, 2004

(65) Prior Publication Data

US 2004/0187510 A1 Sep. 30, 2004

(30) Foreign Application Priority Data

Mar. 29, 2003 (KR) ..... 10-2003-0019796

(51) Int. Cl.
*F25D 11/02* (2006.01)

(52) U.S. Cl. ..... 62/441; 62/298

(58) Field of Classification Search ..... 62/298, 62/440, 441, 448

See application file for complete search history.

(56) References Cited

U.S. PATENT DOCUMENTS 2,812,642 A * 11/1957 Jacobs ..... 62/155

3,786,648 A * 1/1974 Rice ..... 62/200

FOREIGN PATENT DOCUMENTS

KR 2002-22184 3/2002

* cited by examiner

*Primary Examiner*—Melvin Jones
(74) *Attorney, Agent, or Firm*—Staas & Halsey LLP

(57) ABSTRACT

A refrigerator designed to prevent inner surfaces of storage compartments thereof from being damaged during a manufacturing process. The refrigerator includes a cabinet defining an external appearance of the refrigerator having refrigerator and freezer compartments therein, a machine room provided on the top of the cabinet to house components required to constitute a refrigerating cycle, first and second evaporators to cool the refrigerator and freezer compartments, a first connecting pipe extended from the first evaporator and led to the machine room through a top wall of the refrigerator compartment, and a second connecting pipe extended from the second evaporator and led to the machine room through a top wall of the freezer compartment, whereby the first and second connecting pipes are connected to each other by a welding operation in the machine room.

11 Claims, 3 Drawing Sheets

REFRIGERATOR

CROSS-REFERENCE TO RELATED APPLICATIONS

This application claims the benefit of Korean Application No. 2003-19796, filed on Mar. 29, 2003, in the Korean Intellectual Property Office, the disclosure of which is incorporated herein by reference.

BACKGROUND OF THE INVENTION

1. Field of the Invention

The present invention relates to a refrigerator, and more particularly, to a refrigerator designed to prevent an inner surface of a storage compartment thereof from being damaged during a manufacturing process.

2. Description of the Related Art

Generally, a refrigerator generates cool air to maintain the freshness of stored food for a desired period of time.

A conventional refrigerator includes a cabinet defining an external appearance of the refrigerator, wherein a refrigerator compartment which stores fresh food in a cool state and a freezer compartment which stores frozen food in a frozen state are completely separated from each other. Accordingly, foods are organized and stored in either the refrigerator compartment or the freezer compartment, according to a temperature suitable for storing the foods.

Recently, an independent cooling type refrigerator has been designed to independently cool a refrigerator compartment and a freezer compartment by providing both the refrigerator and freezer compartments with evaporators, respectively.

In a manufacturing process of the independent cooling type refrigerators, two evaporators are disposed in a refrigerator compartment and a freezer compartment, respectively, and refrigerant pipes extended from the two evaporators are connected to each other by a welding operation in the refrigerator compartment and the freezer compartment, so as to allow the refrigerant to be transmitted from one evaporator to the other evaporator.

Since inner walls of the refrigerator compartment and the freezer compartment are usually made of resin material, when a welding operation is performed in these compartments, the inner wall surfaces may be sooted, damaged or warped due to the heat and fumes generated during the welding operation.

SUMMARY OF THE INVENTION

Accordingly, it is an aspect of the present invention to provide a refrigerator, which prevents damage to inner surfaces of a refrigerator compartment and a freezer compartment, which may occur during an operation of connecting an evaporator in the refrigerator compartment to an evaporator in the freezer compartment.

Additional aspects and advantages of the invention will be set forth in part in the description which follows and, in part, will be obvious from the description, or may be learned by practice of the invention.

The foregoing and/or other aspects of the present invention are achieved by providing a refrigerator including a cabinet defining an external appearance of the refrigerator having a refrigerator compartment and a freezer compartment therein, a machine room provided on the top of the cabinet to house components installed therein to operate a refrigerating cycle of the refrigerator, first and second evaporators to cool the refrigerator and freezer compartments, a first connecting pipe extended from the first evaporator and led to the machine room through a top wall of the refrigerator compartment, and a second connecting pipe extended from the second evaporator and led to the machine room through a top wall defining an upper surface of the freezer compartment.

The top wall of the refrigerator compartment comprising a first communicating duct, which allows the refrigerator compartment to communicate with the machine room and allows the first connecting pipe to pass therethrough, and wherein the top wall defining the upper surface of the freezer compartment may include a second communicating duct, which allows the freezer compartment to communicate with the machine room and allows the second connecting pipe to pass therethrough.

The refrigerator further comprising an auxiliary capillary tube connected between the first and second connecting pipes to cause the first and second evaporators to have different temperatures, and a reception container disposed in the machine room to have the auxiliary capillary tube and the parts of the first and second connecting pipes connected to the auxiliary capillary tube installed therein.

The reception container comprising a case opened on its upper surface to define a reception space and communicating with the first and second communicating ducts, a cover to close the upper open surface of the case, and an insulating member fitted in the reception space between the case and the cover to insulate the auxiliary capillary tube from heat in the machine room of the refrigerator.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
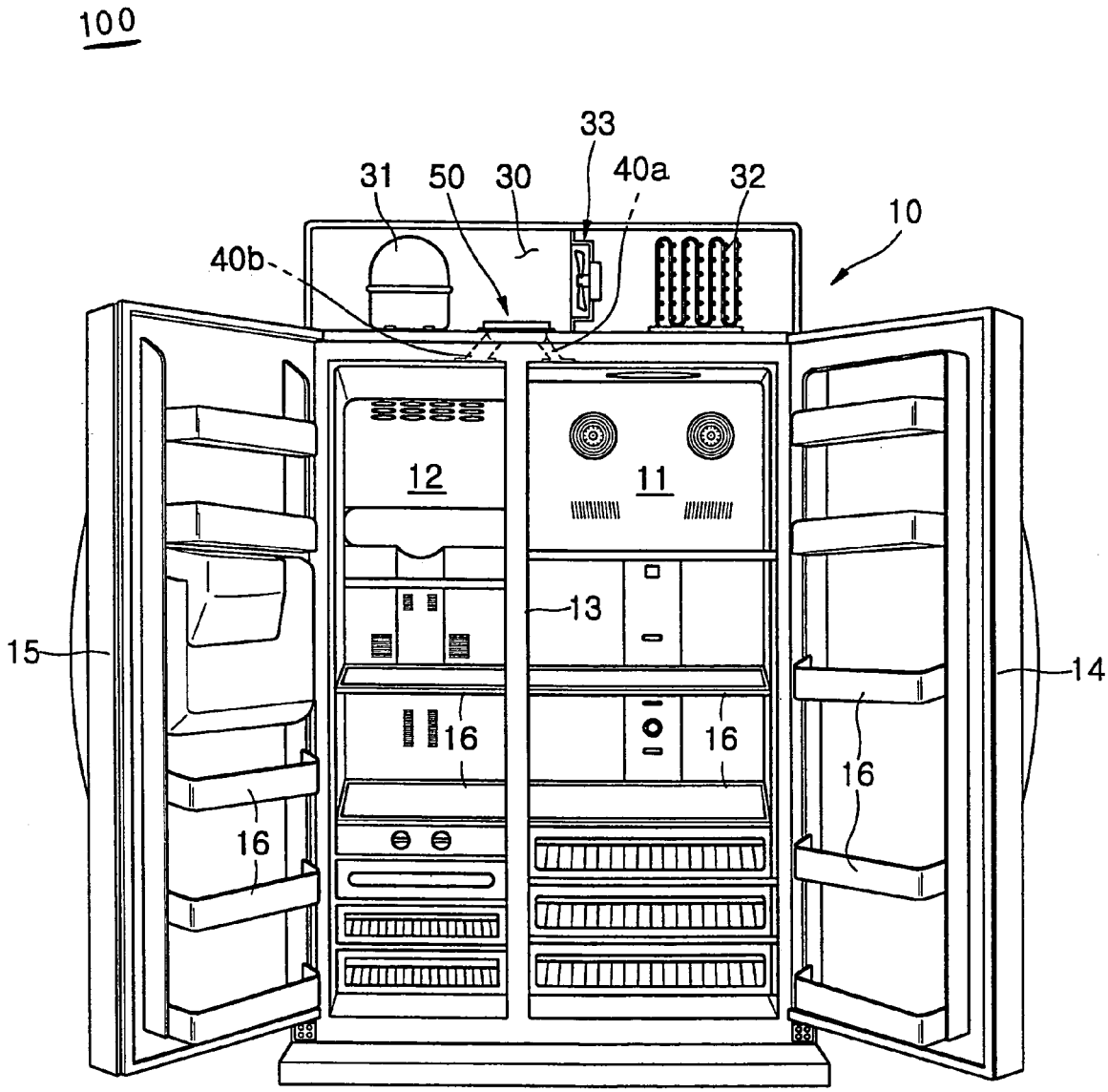
FIG. 1 is a front elevation view of a refrigerator, according to an embodiment of the present invention.

Reference will now be made in detail to the present preferred embodiments of the present invention, examples of which are illustrated in the accompanying drawings, wherein like reference numerals refer to like elements throughout.

Figure 2:
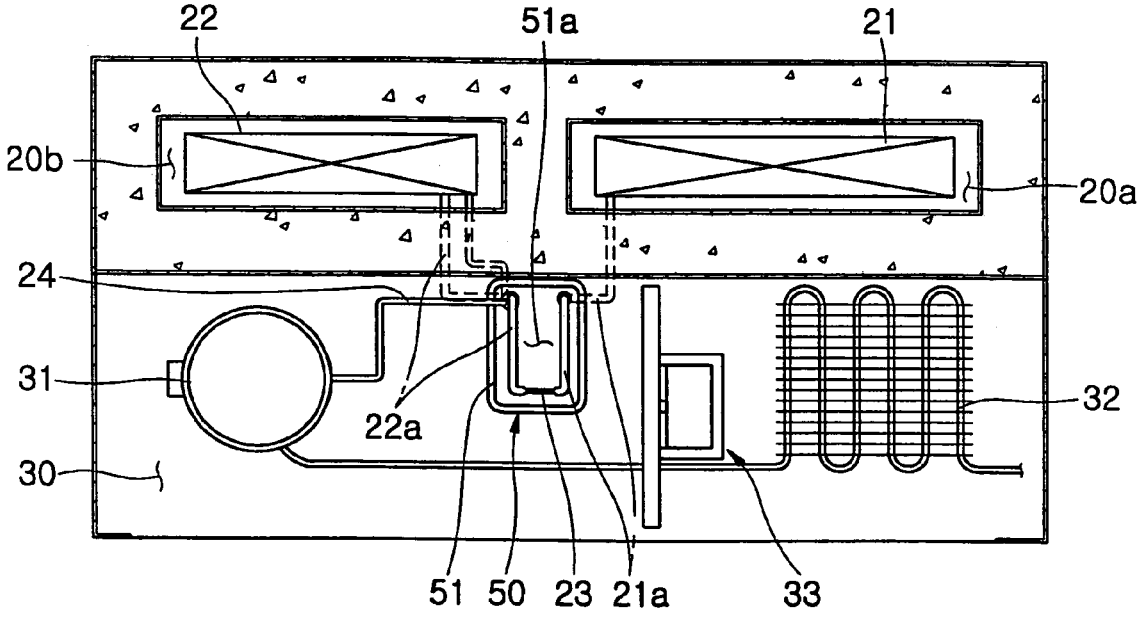
FIG. 2 is a plan cross-sectional view of the refrigerator shown in FIG. 1.

As shown in FIGS. 1 and 2, a storage compartment defined in a cabinet 10 of the refrigerator 100 according to the present invention is partitioned by an intermediate partition wall 13 into left and right storage compartments with openings on the front surfaces thereof. One of the storage compartments forms a refrigerator compartment 11 to store food in a cool state, while the other of the storage compartments forms a freezer compartment 12 to store food in a frozen state.

A refrigerator compartment door 14 is hinged to an open front of the refrigerator compartment 11, and a freezer compartment door 15 is hinged to an open front of the freezer compartment 12. Thus, the two compartments 11 and 12 are independently closed and opened by the two doors 14 and 15. A plurality of racks 16 are installed in each of the two compartments 11 and 12, and on an inner surface of each of the two doors 14 and 15 to store food.

The cabinet 10 is provided on the top thereof with components constituting a refrigerating cycle, such as a compressor 31 to compress the refrigerant, a condenser 32 to cool the compressed refrigerant in high pressure and high temperature, a capillary tube (not shown) to expand the refrigerant under reduced pressure, and a pair of evaporators 21 and 22 to generate cool air by expansion of the refrigerant.

The refrigerator 100 according to the present invention adopts an independent cooling system, in which the refrigerator compartment 11 and the freezer compartment 12 are cooled independently. The first evaporator 21 is used to cool the refrigerator compartment 11, while the second evaporator 22 is used to cool the freezer compartment 12.

The cabinet 10 is provided at a rear side of the top thereof with a first air cooling compartment 20*a* communicating with the refrigerator compartment 11 and having the first evaporator 21, and a second air cooling compartment 20*b* communicating with the freezer compartment 12 and having the second evaporator 22 to install the components required to operate the refrigerator 100. Furthermore, the cabinet 10 is provided at a front side of the top thereof with, a machine room 30 having compressor 31, the condenser 32, and a blowing fan 33 to cool the compressor 31 and the condenser 32 installed therein.

The first and second evaporators 21 and 22 are provided with connecting pipes 21*a* and 22*a*, respectively, so as to allow the refrigerant to be transmitted between the first and second evaporators 21 and 22. More specifically, the first connecting pipe 21*a*, which is connected to the second evaporator 22 to conduct refrigerant thereto, is extended from the first evaporator 21, and the second connecting pipe 22*a*, which is connected to the first connecting pipe 21*a* to receive the refrigerant from the first evaporator 21, is extended from the second evaporator 22.

The first and second connecting pipes 21*a* and 22*a* are connected to each other by a welding operation. In order to connect the first and second connecting pipes 21*a* and 22*a* in the machine room 30, the first connecting pipe 21*a* is led to the machine room 30 from the refrigerator compartment 11 through a top wall of the refrigerator compartment 11, and the second connecting pipe 22*a* is also led to the machine room 30 from the freezer compartment 12 through a top wall of the freezer compartment 12.

To install the first and second connecting pipes 21*a* and 22*a* through the top wall of the refrigerator compartment 11 and the freezer compartment 12, a first communicating duct 40*a* to allow the refrigerator compartment 11 and the machine room 30 to communicate with each other, and a second communicating duct 40*b* to allow the freezer compartment 12 and the machine room 30 to communicate with each other are embedded in the top wall.

Consequently, the first connecting pipe 21*a* extended from the first evaporator 21 is led into the machine room 30 from the refrigerator compartment 11 through the first communicating duct 40*a*, while the second connecting pipe 22*a* extended from the second evaporator 22 is led into the machine room 30 from the freezer compartment 12 through the second communicating duct 40*b*. As a result, the first and second connecting pipes 21*a* and 22*a* are connected to each other by a welding operation in the machine room 30.

In this embodiment, an auxiliary capillary tube 23 is connected between the first and second connecting pipes 21 and 22*a*. The auxiliary capillary tube 23 causes the first and second evaporators 21 and 22 to have different cooling temperatures by allowing the refrigerant passed through the first evaporator 21 to expand under reduced pressure and to be introduced into the second evaporator 22. Consequently, the refrigerator compartment 11 and the freezer compartment 12 are efficiently cooled.

Since the machine room 30 is maintained at relatively high temperatures due to heat generated from the compressor 31 and the evaporators 21 and 22, the auxiliary capillary tube 23 is affected by an internal temperature in the machine room 30, thereby decreasing the efficiency of the refrigerating cycle.

Accordingly, in order to prevent the auxiliary capillary tube 23 from being affected by an internal temperature in the machine room 30, a reception container 50 to receive the auxiliary capillary tube 23 is provided on the top wall of the refrigerator.

Figure 3:
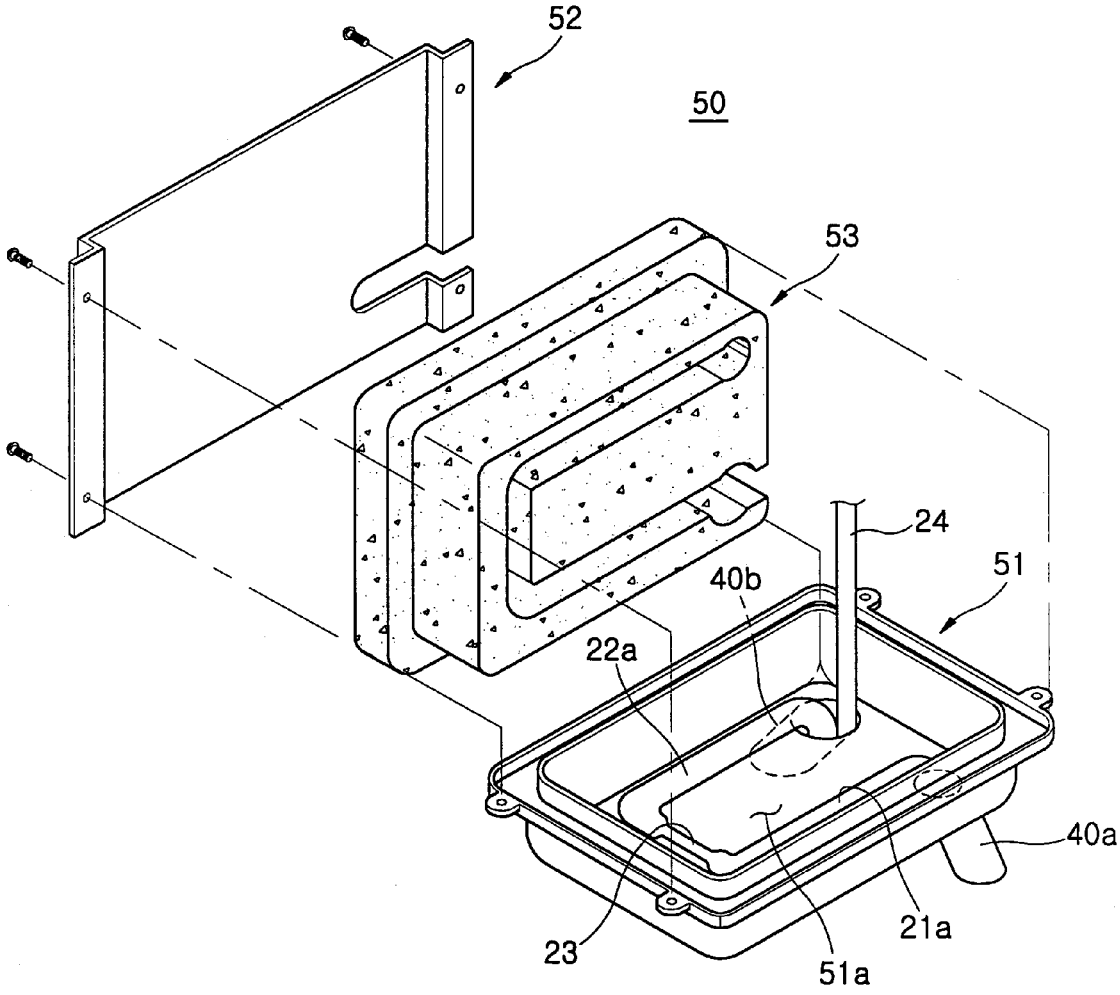
FIG. 3 is an exploded perspective view of a reception container to house a capillary tube, according to an embodiment of the present invention.

As shown in FIG. 3, the reception container 50 comprising a case 51 opened at its upper surface to define a reception space 51*a* and integrally formed on a bottom plate thereof with the first and second communicating ducts 40*a* and 40*b*, a cover 52 to close the upper open surface of the case 51, and an insulating member 53 fitted in the reception space between the case 51 and the cover 52 to insulate the auxiliary capillary tube 23 from heat. The reception container 50 is partially embedded at a bottom portion thereof in a bottom wall of the machine room 30.

A suction pipe 24 is extended from the second evaporator 22 through the second communicating duct 40*b* and the cover 52, and connected to the compressor 31 to transmit refrigerant to the compressor 31 from the second evaporator 22.

A manufacturing process and functions of the refrigerator according to the present invention will now be described.

First, the first and second evaporators 21 and 22 are installed in the first and second air cooling compartments 20*a* and 20*b* through the refrigerator compartment 11 and the freezer compartment 12, respectively. The first connecting pipe 21*a* extended from the first evaporator 21 is led to the machine room 30 through the first communicating duct 40*a*, and the second connecting pipe 22*a* extended from the second evaporator 22 is also led to the machine room 30 through the second communicating duct 40*b*. Subsequently, the auxiliary capillary tube 23 is connected between the first and second connecting pipes 21*a* and 22*a*, both of which are led to the machine room 30, by a welding operation. Consequently, the first evaporator 21 communicates with the second evaporator 22 through the first and second connecting pipes 21*a* and 22*a*, thereby allowing the refrigerant to be transmitted to the second evaporator 22 from the first evaporator 21.

Thereafter, the auxiliary capillary tube 23, which is connected between the first and second connecting pipes 21*a* and 22*a*, is received into the reception space 51*a* of the reception container 50, and an insulating member 53 is fitted in the reception space 51*a*. The upper end of the reception container 50, which exposes the insulating member 53 to the outside, is covered with the cover 52. Consequently, it is possible to prevent heat in the machine room 30 from being transmitted to the auxiliary capillary tube 23.

As apparent from the above description, the present invention provides a refrigerator, wherein first and second connecting pipes 21*a* and 22*a*, which allow refrigerant in a first evaporator 21 to be transmitted to a second evaporator 22, are led to a machine room 30 through first and second communicating ducts 40*a* and 40*b*. Since the first and second connecting pipes 21*a* and 22*a* are connected to each other via an auxiliary capillary tube 23 in the machine room 30 rather than storage compartments, it is possible to prevent storage compartments from being damaged by the welding operation.

Although a preferred embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a cabinet defining an external appearance of the refrigerator including a refrigerator compartment and a freezer compartment therein;

a machine room provided on the top of the cabinet to house components installed therein to operate a refrigerating cycle of the refrigerator;

first and second evaporators to cool the refrigerator and freezer compartments, respectively;

a first connecting pipe extended from the first evaporator and led to the machine room through a top wall of the refrigerator compartment; and a second connecting pipe extended from the second evaporator and led to the machine room through a top wall the freezer compartment.

2. The refrigerator of claim 1,further comprising:

a first communicating duct located in the top wall of the refrigerator compartment, which allows the refrigerator compartment to communicate with the machine room and allows the first connecting pipe to pass therethrough; and a second communicating duct located in the top wall of the freezer compartment, which allows the freezer compartment to communicate with the machine room and allows the second connecting pipe to pass therethrough.

3. The refrigerator of claim 2, further comprising:

an auxiliary capillary tube connected between the first and second connecting pipes to cause the first and second evaporators to have different temperatures; and a reception container disposed in the machine room to house the auxiliary capillary tube and the parts of the first and second connecting pipes connected to the auxiliary capillary tube installed therein.

4. The refrigerator of claim 3, wherein the reception container comprising:

a case having an opening on its upper surface to define a reception space and communicating with the first and second communicating ducts;

a cover to close the upper open surface of the case; and an insulating member fitted in the reception space between the case and the cover to insulate the auxiliary capillary tube from heat in the machine room of the refrigerator.

5. The refrigerator of claim 1, wherein the first and second connecting pipes are welded to each other.

6. The refrigerator of claim 1, further comprising:

a first air cooling compartment communicating with the refrigerator compartment and having the first evaporator located therein; and a second air cooling compartment communicating with the freezer compartment and having the second evaporator located therein.

7. The refrigerator of claim 1, wherein the cabinet is provided at a front side of a top of the refrigerator with the machine room, wherein the machine room comprising:

a compressor to compress a refrigerant;

a condenser to cool the compressed refrigerant in high pressure and high temperature; and a blowing fan to cool the compressor and the condenser.

8. The refrigerator of claim 1, wherein the refrigerator compartment and the freezer compartment are cooled independently.

9. The refrigerator of claim 1, wherein the first connecting pipe is connected to the second evaporator to transmit refrigerant thereto, and the second connecting pipe is connected to the first connecting pipe to receive the refrigerant from the first evaporator.

10. The refrigerator of claim 4, further comprising a suction pipe extended from the second evaporator through the second communicating duct and the cover and connected to a compressor to transmit refrigerant to the compressor from the second evaporator.

11. A method of connecting evaporators in a refrigerator, the method comprising:

installing a first evaporator and a second evaporator in a first and a second air cooling compartment through a first compartment and a second compartment, respectively;

installing a first connecting pipe through a first communicating duct to the first evaporator and installing a second connecting pipe through a second communication duct to the second evaporator;

connecting an auxiliary capillary tube between the first and the second connecting pipes by a welding operation allowing refrigerant to be transmitted to the second evaporator from the first evaporator;

positioning the auxiliary capillary tube into a reception space of a reception container;

fitting an insulating member into the reception space; and covering the reception container with a cover to prevent heat in a machine room from being transmitted to the auxiliary capillary tube.

* * * * *

UNITED STATES PATENT AND TRADEMARK OFFICE

CERTIFICATE OF CORRECTION

PATENT NO. : 7,231,782 B2
APPLICATION NO. : 10/756385
DATED : June 19, 2007
INVENTOR(S) : Sang Gyu Jung It is certified that error appears in the above-identified patent and that said Letters Patent is hereby corrected as shown below:

Column 5, Line 28, change “1,further” to --1, further--.

Signed and Sealed this

Thirtieth Day of October, 2007

JON W. DUDAS
*Director of the United States Patent and Trademark Office*